United States Patent [19]

Langowski

[11] Patent Number: 4,766,796

[45] Date of Patent: Aug. 30, 1988

[54] UNIVERSAL MUTE FOR VERTICAL PIANOS

[76] Inventor: Laurence A. Langowski, Rte. 3, Box 179, Austin, Minn. 55912

[21] Appl. No.: 122,681

[22] Filed: Nov. 19, 1987

[51] Int. Cl.[4] ..... G10C 3/26
[52] U.S. Cl. ..... 84/220; 84/216
[58] Field of Search ..... 84/216, 219, 220, 234

[56] References Cited

U.S. PATENT DOCUMENTS

| | | | |
|---|---|---|---|
| 2,237,990 | 4/1941 | Hewlett | 84/219 |
| 2,727,420 | 12/1955 | Welsh | 84/220 |
| 2,975,665 | 3/1961 | Rothman et al. | 84/224 |
| 4,450,747 | 5/1984 | Aoyama | 84/220 |

*Primary Examiner*—Lawrence R. Franklin

[57] ABSTRACT

A universal mute for vertical pianos that as a unit mounts to the tuning pins with adjustment capability to establish installability in existing vertical pianos of various size, age and origin.

4 Claims, 1 Drawing Sheet

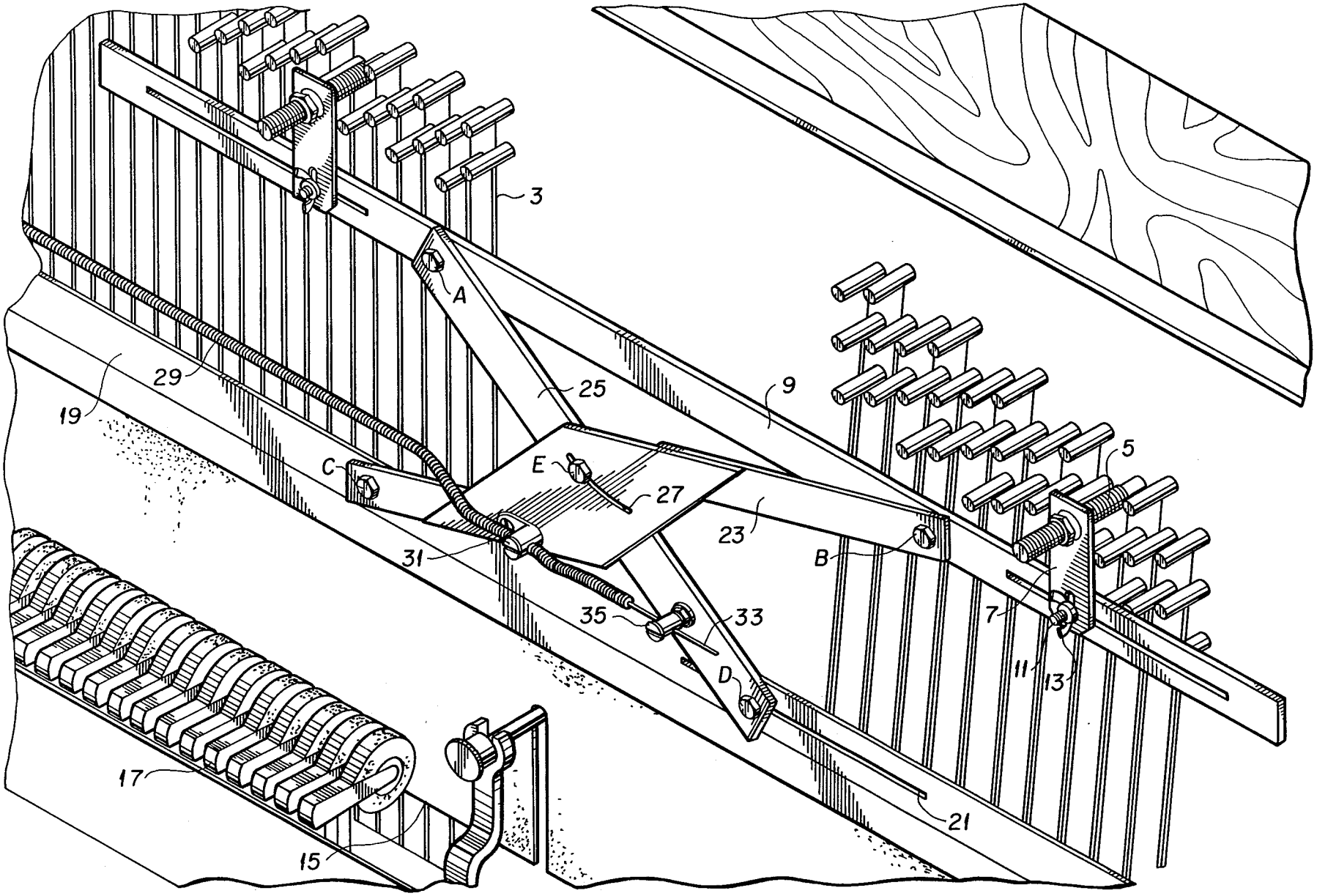
5
13
11
7
21
B
9
23
33
D
27
35
25
E
3
A
31
C
15
29
17
19

UNIVERSAL MUTE FOR VERTICAL PIANOS

This invention relates to an improvement in piano accessories and is especially concerned with a curtain rail type practice muffler that is universally attachable to all types of exiting vertical pianos.

The objective of this invention is to provide a practice muffler that can be installed, as a unit, in any of the various existing vertical pianos, without requiring special machinery, specific skills or alteration of the piano.

An advantage of this invention over existing mufflers is that this invention has a retro-fit application and is truly universal in application to all of the existing vertical pianos whether old or new, foreign or domestic in origin.

In the construction of a conventional muffler assembly for vertical pianos certain structural requirements must exist for the assembly to be mounted to the piano. On many muffler designs fixed case side boards that extend up to the piano's lid and out from the plate past the action assembly must be present to provide end mounting surfaces. Another type of muffler requires action mounting bolts that protrude from the piano's plate at or above the action hammers, allowing support for the curtain rail. These conditions do not universally exist on vertical pianos.

This invention differs fundamentally from any previous muffler in that the assembly mounts directly to the tuning pins of the piano, taking advantage of a consistent design feature, with all the necessary adjustments to make it installable in any of the wide range of sizes and types of vertical pianos. With the use of a linkage cable, the muffler can be moved to an on or off position allowing the instrument to function normally or to be muted.

Noteworthy among the features of this muffler are its ability to be installed as a unit, its nonintrusive nature on the normal function of the piano, its simplicity of function in achieving all the necessary adjustments to be universal and its ease of removal and reinstallation to allow tuning.

BRIEF DESCRIPTION OF THE DRAWING

The drawing is a perspective elevational veiw of the upper center portion of a vertical piano with the front removed and the assembly mounted on the tuning pins.

The piano muffler provided according to this invention is illustrated in the accompanying drawing. The piano's upper harp is exposed showing the tuning pins (1) the upper portion of the pianos strings (3) (wires) and the top portion of the piano's action. The muffler is mounted to the pins in the muting (muffler) or on position. The description of the illustration will fall into three interconnected assemblies, the mounting assembly, the muting assembly and the connecting assembly.

All vertical pianos have a vertically placed bank of tuning pins extending end to end across the front facing top of the piano's interior with the pins being universal in nature to allow the use of a standardized tuning tool. The mounting assembly of this invention takes advantage of these standard elements and attaches to two pins using separate threaded tubes (5) that slip snugly over the pins. The tubes and pins easily provide sufficient rigidity to secure the muffler with a negligible impact on the pitch of the associated strings. The threaded tubes thread through a grooved mounting bracket (7) which in turn is connected to the grooved mounting rail (9) by way of a bolt (11) capable of sliding along the associated grooves and able to be easily tightened by way of a winged nut (13).

This mounting assembly provides for some of the essential adjustments to make the muffler universal. The grooved mounting bracket and rail with a hand tightenable connection allows quick access by the threaded tubes, to a wide range of pin locations and the ability to position the muffler up, down, left or right as needed. The threaded tube can be wound through the mounting bracket achieving various distances for the muffler, from the pianos harp, allowing the muffler to clear any protrusions from the harp such as agraffe bolts or pressure bars, and is also helpful in placing the muting strip (15) between the hammers (17) and strings.

The muting assembly consists of the muting rail (19) with the muting strip (or tone altering material) bonded to and hanging from it. The muting rail being constructed of a metal and possessing shape memory is rigid enough to support itself and the muting strip material yet sufficiently malleable to be bent to achieve proper location of the muting strip in the path of the activated hammers and strings. The muting rail has a slot (21) used in the height adjustment function of the connecting assembly.

The connecting assembly achieves the height adjustment function of the muting assembly. It consists of crossing members, the facing member (23) and the opposing member (25), with the arms connected to the mounting rail at pivoting points (A&B) and to the muting rail at one pivoting point (C) and at slot 21 which provides a path for connection (D) to slide along. A curved slot (27) on the facing cross member provides a path for the center connection (E) to travel along, sliding in conjunction with slot 21 making the connecting assembly able to collapse or extend, placing the muting rail at various distances from the mounting rail as needed by various sized pianos while maintaining an essentially parallel relationship between the mounting and muting rails. The extent to which the connecting assembly is to be extended or collapsed is controlled by a center slipping cable (29) positioned through a facing set screw bracket (31) with the center slipping wire (33) positioned through opposing set screw bracket (35). The cable is run along the piano's bass side to the side board and down to the pianos exterior under the key bed where the control knob is mounted at a convenient location. The in and out motion of the control knob through the center slipping wire sets the final height of the muting assembly. The muffler as a whole is positioned such that the final height adjustment achieved with the control knob places the muting strip down between the hammers and strings in the path of the activated hammer or up out of the way of the hammer's motion.

I claim:

1. A muffler assembly for vertical pianos, said muffler assembly comprising:

a muting assembly adapted to extend horizontally across the strings of said vertical piano, said muting assembly including muting material attached to a muting rail acting as an impact absorbing mute when placed between an activated hammer and a piano string;

a mounting assembly for connecting said muting assembly to the tuning pins of said vertical piano, said mounting assembly being capable of adjusting said muting assembly relative to said tuning pins, said mounting assembly including coupling means for grasping at least one tuning pin; and a connecting assembly connecting said mounting assembly and said muting assembly for selectively moving said muting assembly between a muting position and a non-muting position.

2. The muffler assembly of claim 1 where in said connecting assembly comprises a control cable connected to linkage joining said mounting assembly and said muting assembly.

3. The muffler assembly of claim 2 wherein said coupling means grasps at least two tuning pins.

4. The muffler assembly of claim 3 wherein said coupling means consists of a pair of externally threaded tubes, the interiors of which are shaped to slip snugly over said tuning pins, and said mounting assembly including a threaded link adjustably connecting tubes to said linkages.

* * * * *